US006679751B1

(12) United States Patent
Maxwell et al.

(10) Patent No.: US 6,679,751 B1
(45) Date of Patent: Jan. 20, 2004

(54) STACKABLE ARTICLES TOY FOR CHILDREN

(75) Inventors: Matthew C. Maxwell, East Aurora, NY (US); Jerry A. May, Colden, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/987,090

(22) Filed: Nov. 13, 2001

(51) Int. Cl.[7] ..... A63H 33/04
(52) U.S. Cl. ..... 446/91; 446/397; 446/124
(58) Field of Search ..... 446/90, 91, 96, 446/127, 119, 117, 116, 85, 484; 273/156, 440, 460

(56) References Cited

U.S. PATENT DOCUMENTS

| | | | | |
|---|---|---|---|---|
| 1,388,710 A | * | 8/1921 | Hime | |
| 2,315,793 A | | 4/1943 | Jay | |
| 2,725,234 A | | 11/1955 | Coble et al. | |
| 3,237,341 A | * | 3/1966 | Janning | |
| 3,696,548 A | * | 10/1972 | Teller | |
| 3,765,121 A | | 10/1973 | Vennola | |
| 3,975,858 A | * | 8/1976 | Much | |
| 4,249,333 A | | 2/1981 | Chase et al. | |
| 4,334,382 A | * | 6/1982 | Chase et al. | 46/1 R |
| 4,348,191 A | * | 9/1982 | Lipsitz et al. | 434/308 |
| 4,418,915 A | * | 12/1983 | Calebs | 273/159 |
| 4,485,585 A | | 12/1984 | Shackelford et al. | |
| 4,509,920 A | | 4/1985 | Kaufmann | |
| 4,556,393 A | * | 12/1985 | Bolli | 446/91 |
| 4,604,073 A | | 8/1986 | Livesey et al. | |
| D289,533 S | | 4/1987 | Morrison | |
| 4,720,283 A | | 1/1988 | Williams et al. | |
| 4,787,876 A | | 11/1988 | Nguyen et al. | |
| 4,869,701 A | * | 9/1989 | Kawai et al. | 446/91 |
| 4,930,645 A | * | 6/1990 | Warehime | 215/11.1 |
| 4,936,185 A | * | 6/1990 | Yamaguchi et al. | 84/670 |
| 4,936,780 A | | 6/1990 | Cogliano | |
| 5,190,287 A | | 3/1993 | Ishiyama | |
| 5,344,148 A | | 9/1994 | Asch | |
| 5,346,399 A | | 9/1994 | Sakow | |
| 5,713,782 A | | 2/1998 | Jensen et al. | |
| 5,779,515 A | * | 7/1998 | Chung | 446/90 |
| 5,931,677 A | | 8/1999 | Rifat et al. | |
| D420,060 S | | 2/2000 | Yamazaki | |
| 6,132,281 A | | 10/2000 | Klitsner et al. | |
| 6,190,228 B1 | | 2/2001 | Hoogenboom et al. | |
| 6,271,453 B1 | * | 8/2001 | Hacker | 84/476 |
| 6,443,796 B1 | * | 9/2002 | Shackelford | 446/91 |

OTHER PUBLICATIONS www.fisherprice.com, see attached.*

* cited by examiner

*Primary Examiner*—Jacob K. Ackun
*Assistant Examiner*—Jamila Williams
(74) *Attorney, Agent, or Firm*—Cooley Godward LLP

(57) ABSTRACT

A stackable articles toy including a number of articles that can be coupled together or coupled to a support and which also generates sensory output upon interaction by the infant with the toy to prolong the infant's enjoyment of the toy.

25 Claims, 10 Drawing Sheets

STACKABLE ARTICLES TOY FOR CHILDREN

BACKGROUND

1. Field of the Invention

The present invention relates generally to infant toys, and more particularly, to a toy that includes stackable articles.

2. Discussion of Related Art

Conventional toys that have stackable rings, blocks, and the like, generally include a support structure with a post upon which an infant can place a number of rings or other similar objects. The objects are separate from the support structure and therefore are frequently misplaced thereby reducing the toy's usefulness and the entertainment benefit for the child.

In some conventional applications, pockets or other types of recesses are provided for the objects, but these too are not sufficient to prevent separation of the play objects from the base structure of the toy.

Another problem with conventional toys is that children quickly become bored with the toy and eventually lose interest altogether. A need exists for a toy that couples the play objects together or to a base support structure to prevent separation of the individual pieces of the toy. A need also exists for a toy that incorporates sensory outputs to keep the infant's attention thereby providing prolonged entertainment for the infant.

SUMMARY OF THE INVENTION

The present invention solves the problems with, and overcomes the disadvantages of, conventional toys. In particular, the present invention provides a toy with multiple play pieces that can be coupled together. The invention also includes sensory output generators that are actuated when the pieces are coupled together or coupled to a support. In an alternative embodiment, the invention includes a stackable play ring toy that includes a number of articles that can be coupled together or coupled to a support and which also generates sensory output upon interaction by the infant with the toy to prolong the infant's enjoyment of the toy.

DETAILED DESCRIPTION

A toy includes a first article and a second article. In one embodiment, the first article and the second article include engagement portions adapted to releasably couple the first and second articles together. The first and second articles are also permanently coupled together using a coupler coupled between the first and the second articles.

In one embodiment, a toy article is engageable with a support. The support includes a base and a support member extending upwardly from the base. The toy article includes a body portion that is releasably engageable with the support and a coupler coupled to and between the body portion and the support. In an alternative embodiment, a plurality of toy articles are removably engageable with the support. In one embodiment, the plurality of toy articles include a coupler disposed between each of the articles and the support. In an alternative embodiment, the plurality of toy articles include a coupler that is coupled to another one of the toy articles.

Figure 1:
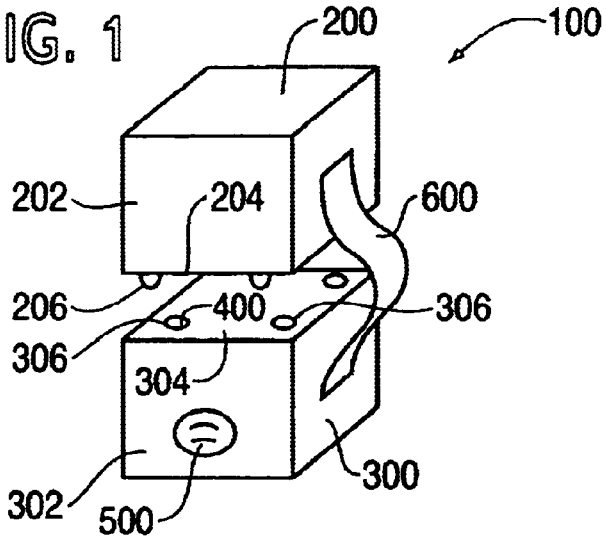
FIG. 1 is an exploded perspective view of a toy according to an embodiment of the invention.

A toy 100 according to an embodiment of the invention is illustrated in FIG. 1. In the illustrated embodiment, toy 100 includes a first toy article 200 and a second toy article 300. First toy article 200 and second toy article 300 can be formed in any suitable shape or combination of shapes, such as a box, cylinder, toroid, or the like.

Article 200 includes a body portion 202. Body portion 202 includes a side or engagement portion 204 that includes a coupler 206. As best seen in FIG. 1, coupler 206 includes four protrusions or posts. Any number of couplers 206 could be employed in the present invention.

As illustrated in FIG. 1, article 300 includes a body portion 302. Body portion 302 includes a side or engagement portion 304 that includes a coupling member 306 in the form of four recesses 306. Recesses 306 are configured or adapted to releasably engage the posts of coupler 206 when first article 200 is brought into contact with second article 300, as will be described in more detail below.

An actuator 400 is disposed within recess 306. In alternative embodiments, an actuator 400 can be disposed within each of recesses 306. In yet a further alternative embodiment, actuator 400 can be disposed at any suitable location on side or engagement portion 304 or at any suitable location on article 300. In a further alternative embodiment, actuator 400 can be disposed on a surface of article 200. Actuator 400 is operatively coupled to a sensory output generator 500 disposed on article 300. Sensory output generator 500 includes a microcontroller and an output transducer such as a speaker. Alternatively, sensory output generator 500 includes a light, providing visible rather than audible output, and the electronics could be simpler or even include only switch 400, a light, and a power supply. Actuator 400 can include any conventional switch or microswitch which are well known to one of ordinary skill in the art.

As shown in FIG. 1, a tether 600 is coupled to first article 200 and second article 300. Tether 600 is adapted to retain first article 200 and second article 300 in a coupled arrangement. Tether 600 should be of sufficient length to allow engagement portion 204 of first article 200 to be engaged with engagement portion 304 of second article 300. Tether 600 can be coupled to any side or portion of articles 200 and 300 using any conventional mechanism or could be formed integrally with article 200 and article 300.

Figure 1A:
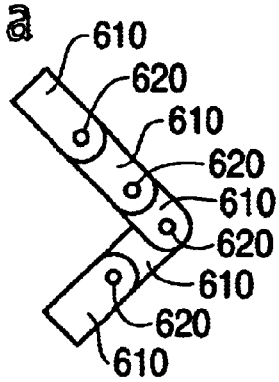
FIG. 1*a* is a side view of an alternative embodiment of a tether according to the invention.

Tether 600 is made from a flexible or pliable fabric material in the form of a ribbon. Alternatively, tether 600 could be made from plastic or other suitable material and can be in the shape of a string, chain, and the like. A further alternative embodiment for tether 600 is shown in FIG. 1*a*. In this embodiment, tether 600 includes a plurality of jointed rigid members 610 joined together using any conventional mechanism such as rivets, screws, and the like. Each of the rigid members 610 rotate about each end joint 620 such that article 200 and article 300 can be moved relative to each other.

First article 200 can be releasably engaged with the second article 300 by engaging engagement portion 204, and more specifically, post 206, with engagement portion 304, and more specifically, within recess 306. As post 206 is brought into engagement with recess 306, post 206 actuates actuator 400 disposed in recess 306. Actuation of actuator 400 causes sensory output generator 500 to produce a sensory output such as music.

Figure 2:
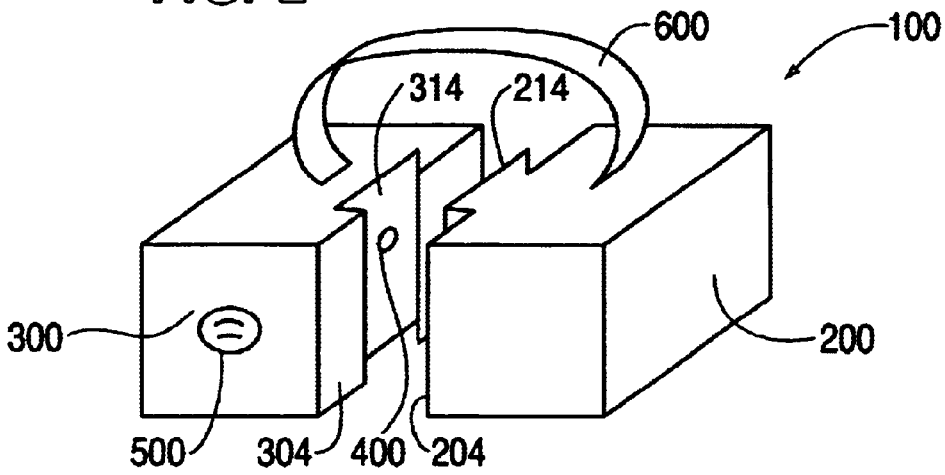
FIG. 2 is an exploded perspective view of an alternative embodiment of an engagement portion according to the invention.

An alternative implementation of the releasable coupling between articles 200 and 300 is illustrated in FIG. 2. In this implementation, engagement portion 204 includes a coupler 214. In one embodiment, coupler 214 extends along the entire length of side or engagement portion 204. Alternatively, coupler 214 extends for only a portion of the length of side or engagement portion 204.

Engagement portion 304 includes a cavity or recess 314 formed therein extending along the entire length of side or engagement portion 304. Alternatively, recess 314 extends for only a portion of the length of side or engagement portion 304. An actuator 400 is disposed in recess 314 and operates in the manner described above with reference to FIG. 1.

As illustrated in FIG. 2, recess 314 and coupler 214 have a substantially dovetail-shaped configuration. Recess 314 and coupler 214 can, however, have any configuration that facilitates releasably coupling article 200 to article 300.

Figure 3:
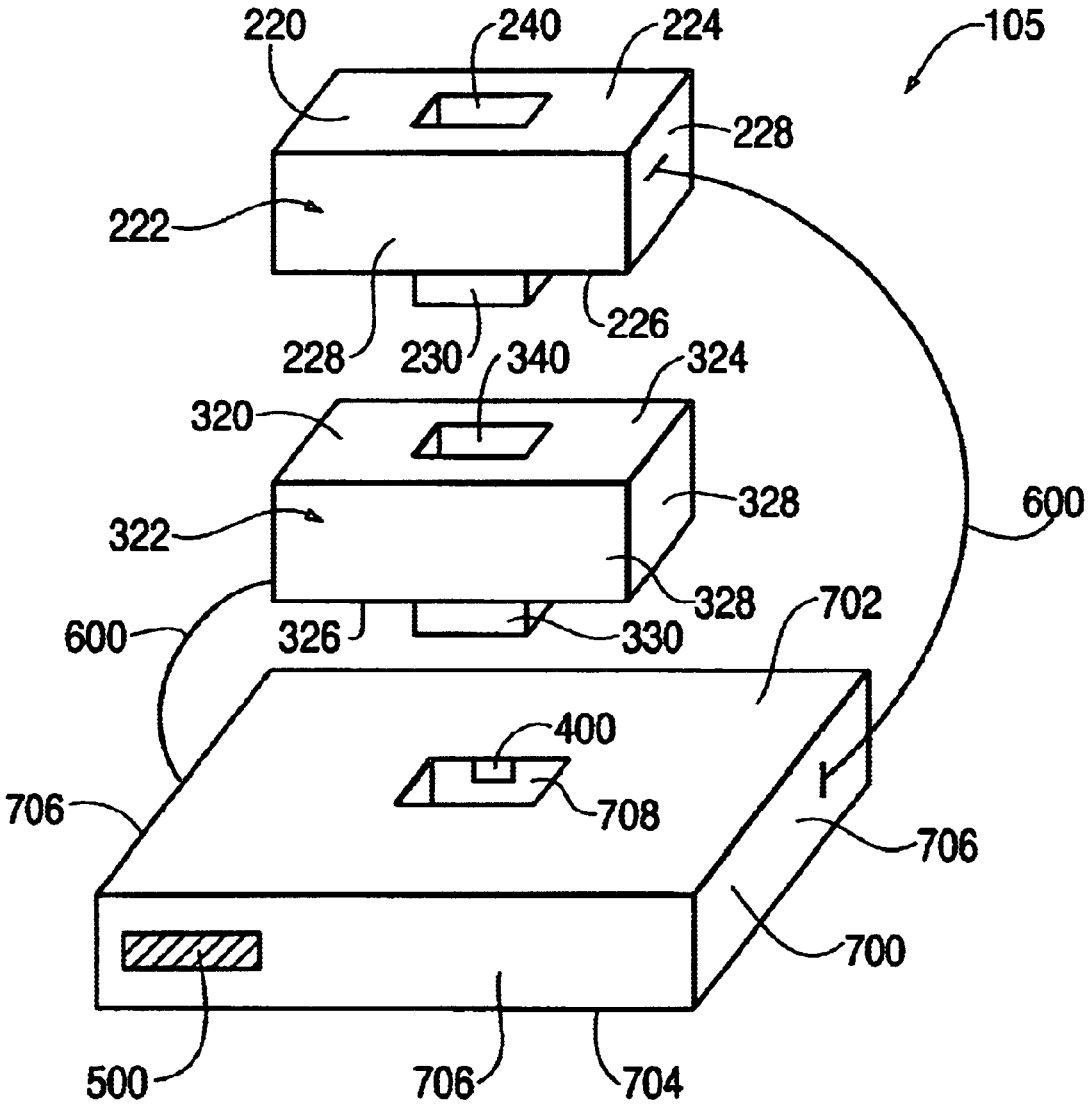
FIG. 3 is an exploded perspective view of an alternative embodiment of a toy according to the invention.
Figure 4:
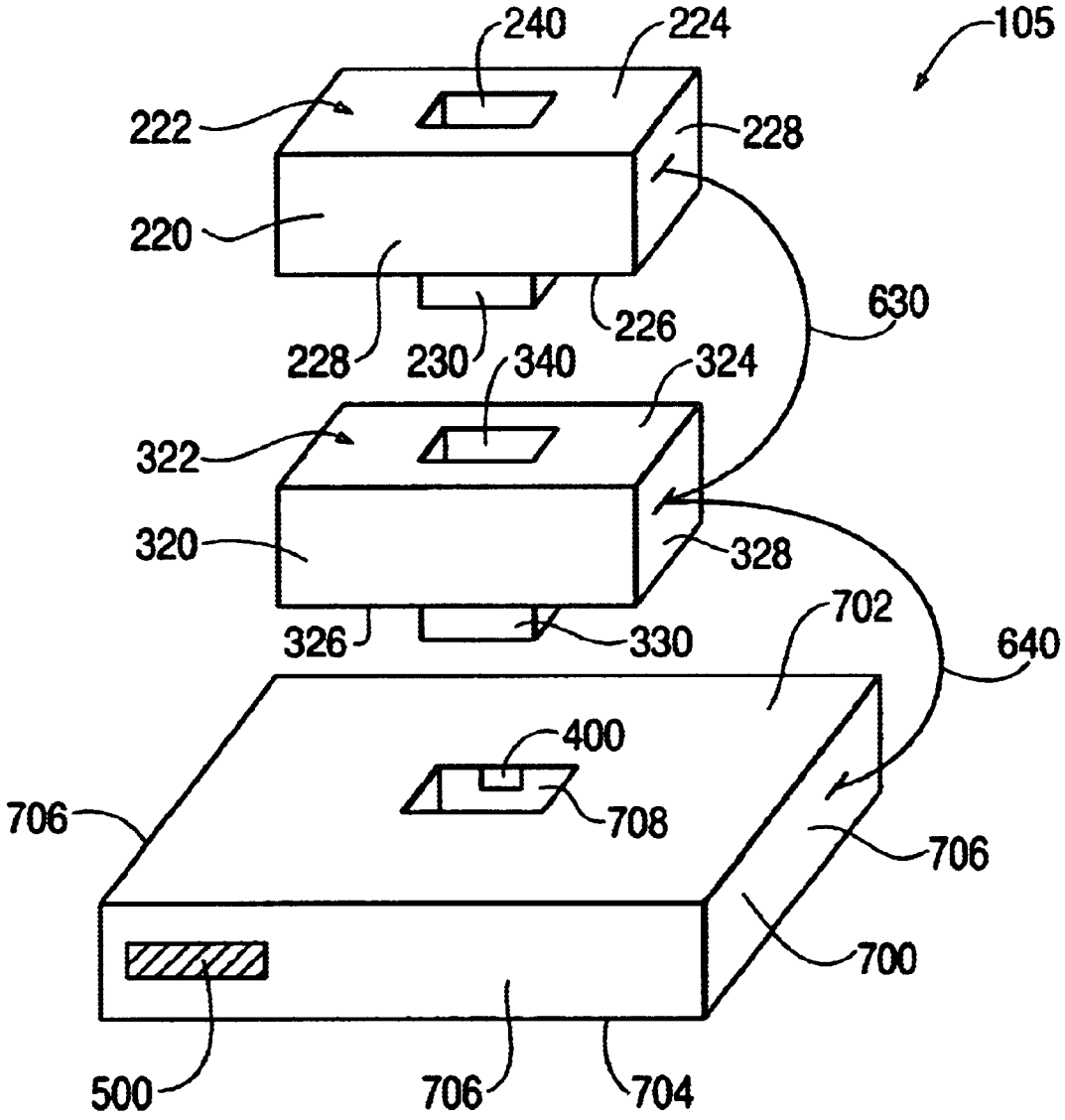
FIG. 4 is an exploded perspective view of an alternative embodiment of a plurality of tethers according to the invention.

An alternative embodiment of the invention is illustrated in FIGS. 3 and 4. Toy 105 includes a stacking arrangement of multiple articles, such as first article 220 and second article 320, which are selectively coupled to each other and to a support or support structure 700.

Support 700 includes an upper surface 702, a lower surface 704, and a number of side surfaces 706. Support 700 is shown in a substantially rectangular configuration but it should be apparent that support 700 can be in any number of suitable configurations, such as circular or triangular. Moreover, support 700 may be any type of support structure, including seats, chairs, wheelchairs, swings, beds, and the like.

Support 700 further includes a recess or cavity 708 formed in the upper surface 702. An actuator 400, as described above with reference to FIGS. 1 and 2, is disposed in cavity 708. In one embodiment, support 700 also includes a sensory output generator 500, which as noted above can include lights or a speaker, operatively coupled to actuator 400.

First article 220 includes a body portion 222 having an upper surface 224, a lower surface 226, and a plurality of side surfaces 228. A coupler or coupling member 230 in the form of a tab or a protrusion is disposed on lower surface 226. Body portion 222 further includes a recess or cavity 240 formed in upper surface 224.

Second article 320 also includes a body portion 322 having an upper surface 324, a lower surface 326, and a plurality of side surfaces 328. A coupler or coupling member 330 in the form of a tab or a protrusion is disposed on lower surface 326. Body portion 322 further includes a recess or cavity 340 formed in upper surface 324.

As illustrated in FIG. 3, a tether 600 is coupled to and between each of articles 220 and 320 and support 700. In one embodiment, tethers 600 are coupled to support 700 at different points on support 700. Alternatively, tethers 600 could be coupled to support 700 at a common point on support 700. In a further alternative embodiment, a plurality of tethers 600 could be coupled to articles 220 and 320 and in turn coupled to an additional tether or tethers 600 which are coupled to the support 700. The tethers 600 could be formed from any suitable materials as described above and can include a plurality of different configurations as set forth above.

FIG. 4 illustrates a further alternative embodiment wherein a first tether 630 is coupled between article 220 and article 320 and a second tether 640 is coupled between article 320 and support 700.

In operation, each of articles 220 and 320 can be positioned relative to support 700 such that coupling members 230 and 330 are aligned with cavity 708 of support 700 to facilitate releasable engagement of one of articles 220 and 320 onto support 700. For example, if an infant chooses to place article 320 onto support 700, the infant aligns coupler 330 with cavity 708. As the infant places article 320 onto support 700, coupling member 330 passes through cavity 708 until the lower surface 326 of article 320 contacts the upper surface 702 of support 700. As coupling member 330 passes through cavity 708, coupling member 330 actuates switch or actuator 400, which in turn actuates sensory output generator 500 causing lights or sounds.

Following placement of article 320 onto support 700, article 220 can then be placed or stacked on top of article 320. To accomplish this, coupling member 230 is aligned with recess 340 formed in the upper surface 324 of article 320. Coupling member 230 is then lowered into recess 340 until the lower surface 226 of article 220 contacts the upper surface 324 of article 320. In an alternative embodiment, placement of article 220 onto article 320 could also activate actuator 400 to cause lights or sounds to be generated by sensory output generator 500. In a further alternative embodiment, article 220 could be placed onto support 700 before article 320. In this manner, article 320 would be stacked on top of article 220.

It should be apparent that the order in which the articles 220, 320 are stacked onto support 700 can vary as the number of articles available for play vary. In other words, the articles do not have to be stacked in a particular order. Alternatively, however, the couplers could be configured on articles 220 and 320 such that they only fit together in a particular order. In addition, tethers 600 could also be configured to set the particular order in which the articles are disposed on support 700 or on each other. For example, tethers 600 of varying length could be employed to limit the number of available stackable configurations.

Figure 5:
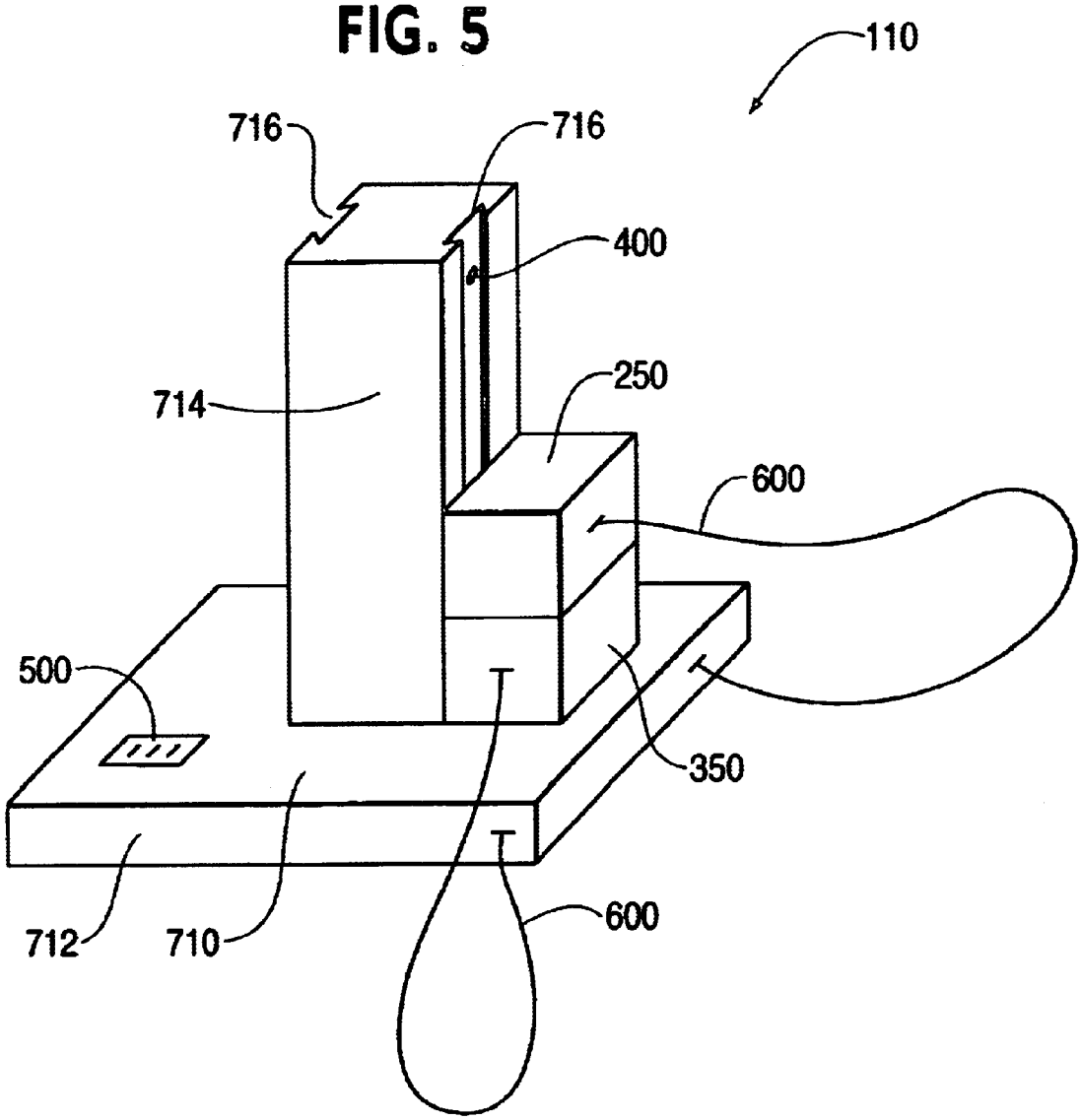
FIG. 5 is a perspective view of an alternative embodiment of a toy according to the invention.
Figure 6:
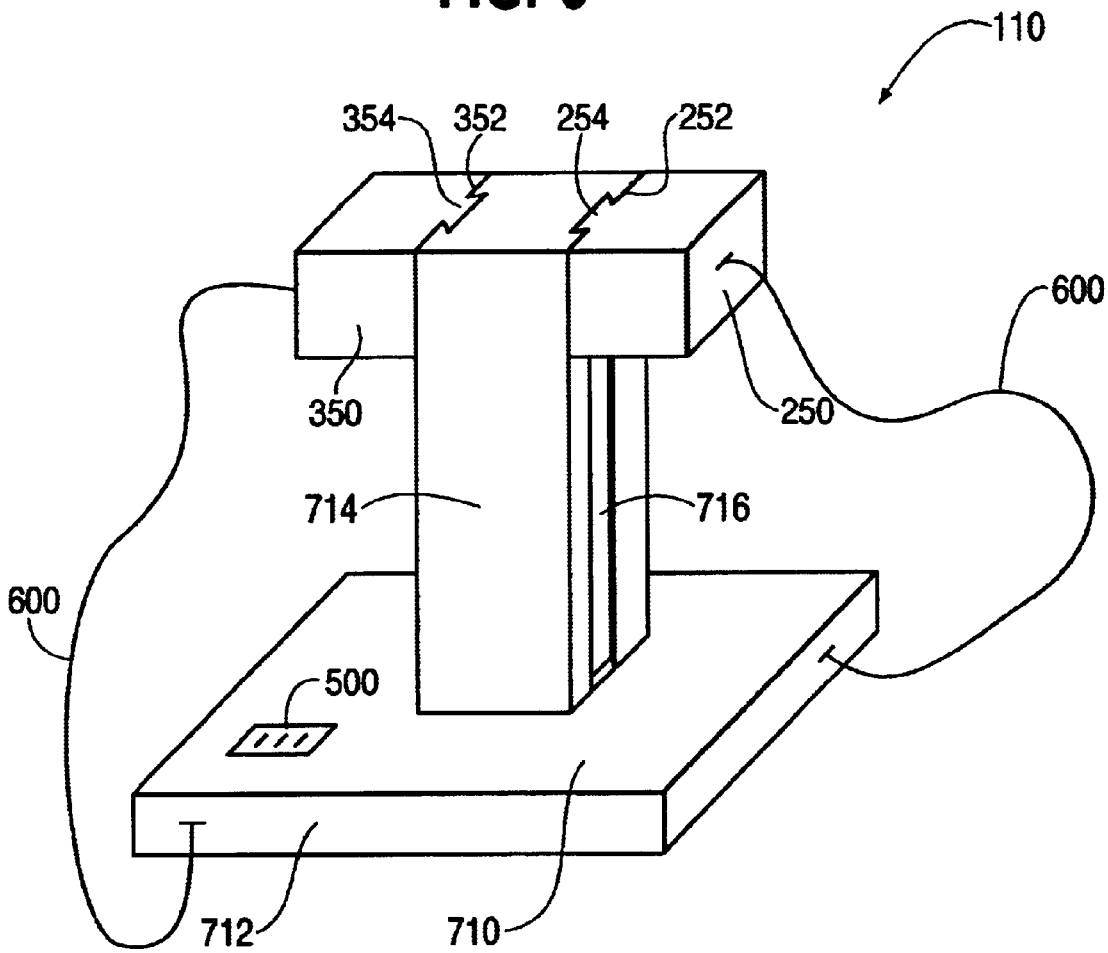
FIG. 6 is a perspective view of an alternative arrangement of the articles of FIG. 5.

A further alternative embodiment of the present invention is shown in FIGS. 5 and 6. As illustrated, toy 110 includes a support 710, which includes a base 712 and a support member or post 714, and a plurality of articles, 250 and 350. As described above, each of articles 250 and 350 have an associated coupler or tether 600 coupled to each of articles 250 and 350 and support 710.

Support member or post 714 extends upwardly from base 712. However, post 714 could be coupled to base 712 in any suitable configuration as long as articles 250 and 350 can removably engage post 714. Post 714 includes a longitudinal groove, recess, or cavity 716. In one embodiment, groove 716 is disposed along the entire length of post 714 to provide a sliding fit arrangement. Alternatively, post 714 can include a number of recesses or cavities to provide a lateral or snap fit arrangement with couplers or protrusions formed on articles 250 and 350, such as the posts 206 shown in FIG. 1. In a further alternative embodiment, groove 716 could be disposed along a portion of the length of post 714. In the illustrated embodiment, two grooves 716 are shown. However, any number of grooves 716 could be employed in the present invention.

As best seen in FIG. 6, article 250 and article 350 include a side or engagement portion 252 and 352, respectively. In one embodiment, engagement portion 252 and 352 include a coupling member 254 and 354, respectively. Coupling members 254 and 354 and groove 716 are illustrated in a dovetail-type configuration. (However, any suitable configuration, such as triangular or circular, may be used to provide a releasable engagement between articles 250, 350 and post 714, and more particularly, groove 716. In an alternative embodiment, the coupling members could be formed on the post 714 and recesses could be formed in the articles 250, 350.

As illustrated in FIG. 5, an actuator 400 of the type described above is disposed in groove 716. It should be apparent that any number of actuators 400 may be disposed in groove 716. A sensory output generator 500 is also disposed on support 710, and more particularly, on base 712. Sensory output generator 500 is operatively coupled to actuator 400 as described above to generate lights and sounds when articles 250, 350 are releasably engaged to post 714, and more particularly when coupling members 254 and 354 contact actuator 400 when articles 250 and 350 are placed onto post 714.

As best seen in FIG. 5, articles 250 and 350 may be stacked on top of each other if the infant chooses to place articles 250 and 350 onto the same side of post 714. Otherwise, articles 250 and 350 can be placed on separate sides of post 714, as best illustrated in FIG. 6.

Figure 7:
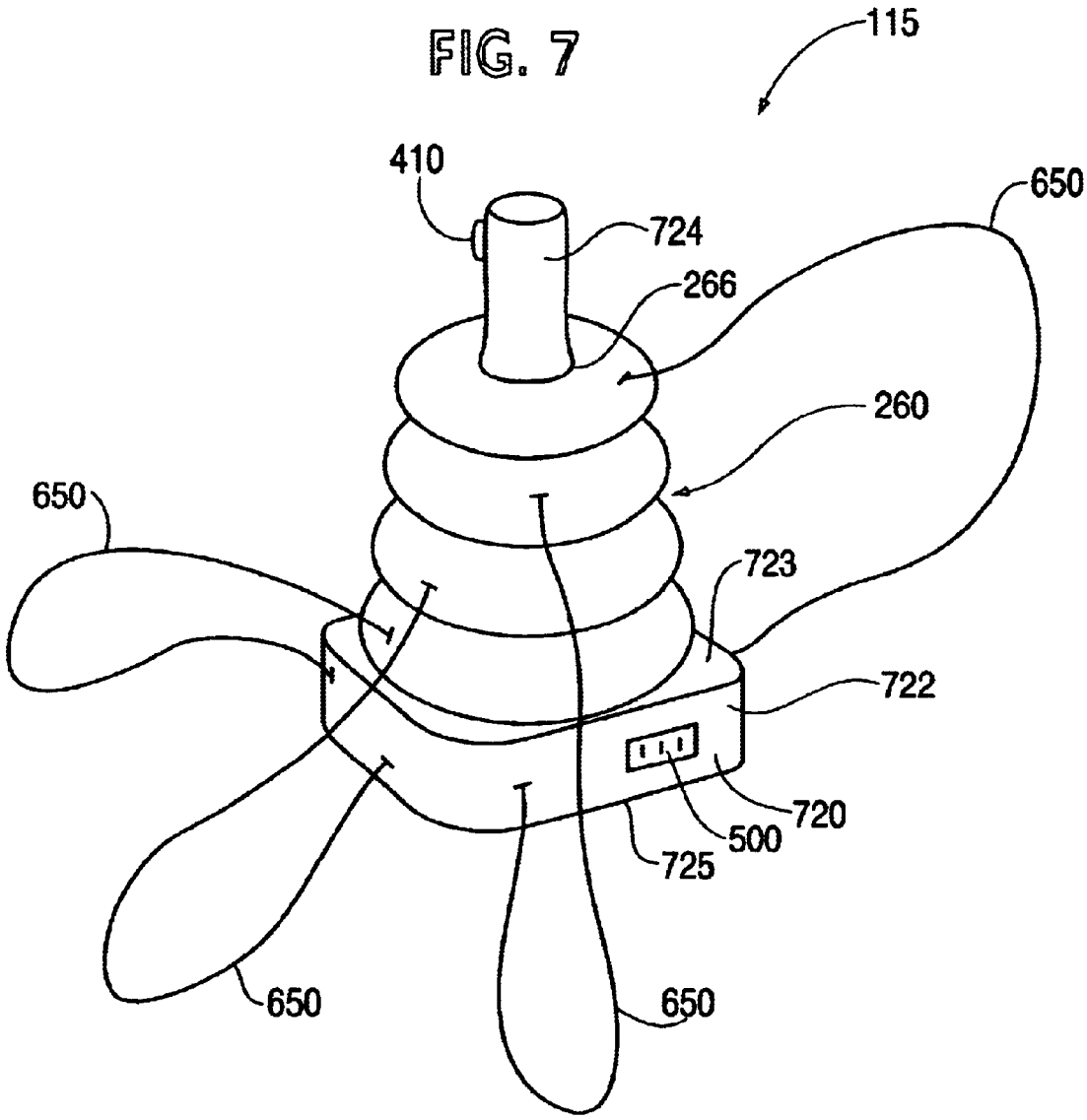
FIG. 7 is a perspective view of an alternative embodiment of a toy according to the invention.

A further alternative embodiment of the toy of the present invention is illustrated in FIGS. 7–11. FIG. 7 illustrates a perspective view of toy 115. Toy 115 includes a plurality of articles 260 and a support 720. Support 720 includes a base 722 and a support member or post 724 extending upwardly from base 722. In one embodiment, toy 115 also includes a plurality of couplers or tethers 650 coupled to and between each of the plurality of articles 260 and the support 720.

Support 720 includes a base portion 722 having a generally rectangular configuration with an upper surface 723 and a lower surface 725. In alternative embodiments, base portion 722 may have any configuration or have any shape that enables the base 722 to support the plurality of articles 260.

As best seen in FIG. 7, an upwardly extending support member or post 724 extends outwardly from the upper surface 723 of base 722. Support member or post 724 may be coupled to base 722 using any suitable mechanism. In an alternative embodiment, support member or post 724 could be formed integrally with base 722.

Post 724 is shown as having a generally cylindrical shape or circular cross-section. Alternatively, support member or post 724 may have any shape that enables the plurality of articles 260 to be disposed along a length of the post 724. For example, post 724 can have a square, triangular, rectangular, hexagonal, or any number of other appropriate geometric shapes.

Support member or post 724 includes an actuator or switch 410 of the type described above disposed on an upper portion of post 724. Alternatively, actuator 410 can be disposed at any number of locations along post 724. In further alternative embodiments, more than one switch 410 can be disposed on post 724.

In the illustrated embodiment of FIG. 7, a sensory output generator 500 of the type discussed above is disposed on the base 722. Sensory output generator 500 is operatively coupled to actuator 410 to generate sensory outputs, such as lights or sounds.

Figure 8:
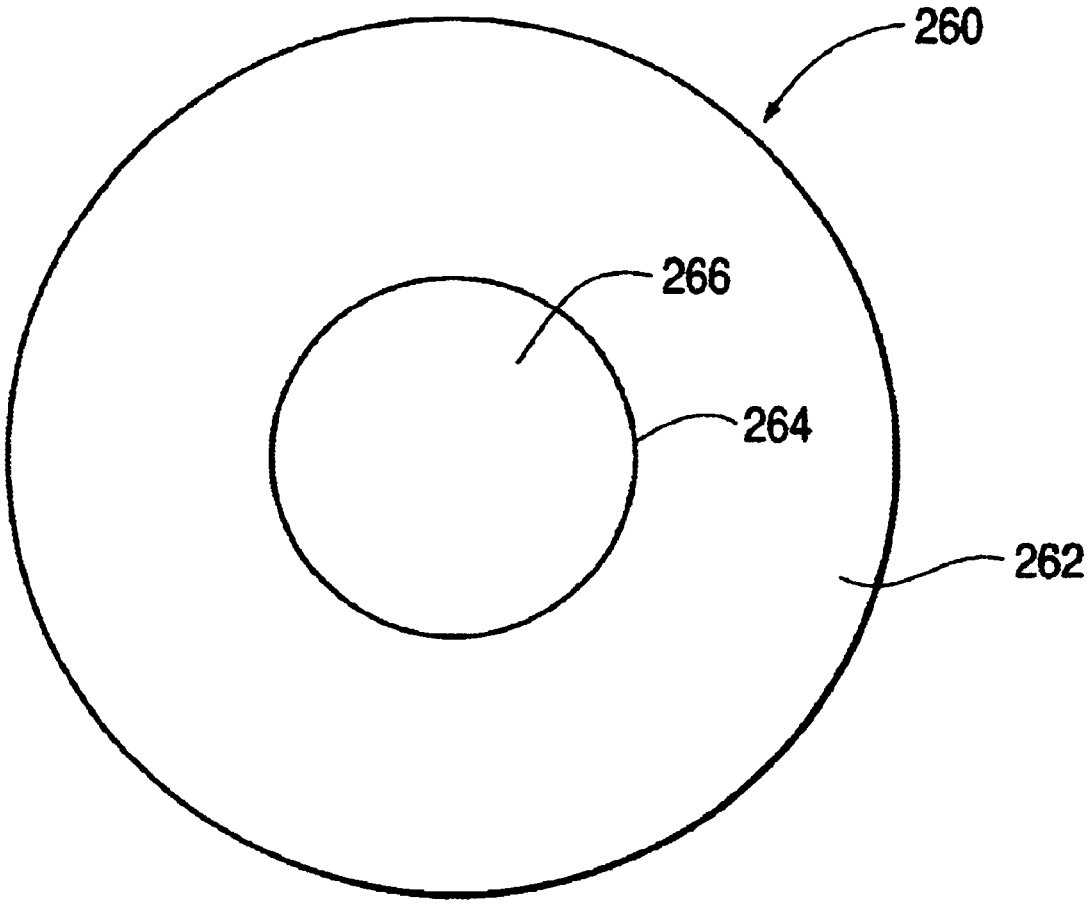
FIG. 8 is a top view of an embodiment of a toy article according to the invention.

A detailed top view of one of the plurality of articles 260 is shown in FIG. 8. In one embodiment, article 260 is formed in a toroidal, annular, or ring-like configuration. In alternative embodiments, article 260 may be any structure or have any shape that enables the article 260 to be disposed on support 720, and more particularly, onto post 724, and that enables the articles 260 to be stacked on top of each other. In the illustrated embodiment of FIG. 8, article 260 includes a body portion 262 having an engagement portion 264, which includes an opening 266 formed through body portion 262. As best seen in FIG. 7, opening 266 is configured such that opening 266 allows article 260 to be placed onto post 724 and moved along post 724 until the article 260 reaches the base 722 or another article 260.

In operation, as the articles 260 are placed onto support member or post 724 and moved towards the base 722, the engagement portion 264 contacts actuator 410. When actuator 410 is contacted it sends a signal to the sensory output generator 500 to generate an output. As noted above, the output can include lights, sounds, or any other suitable output that is entertaining for an infant.

As best seen in FIG. 7, a plurality of couplers or tethers 650 are coupled to and between the plurality of articles 260 and the support 720. More particularly, tethers 650 are coupled to and between the body portion 262 of articles 260 and the base 722. The tethers 650 may be coupled to base 722 at varying points on base 722. In alternative embodiments, tethers 650 may be coupled to base 722 at a common point or area or common, branched tether.

Figure 9:
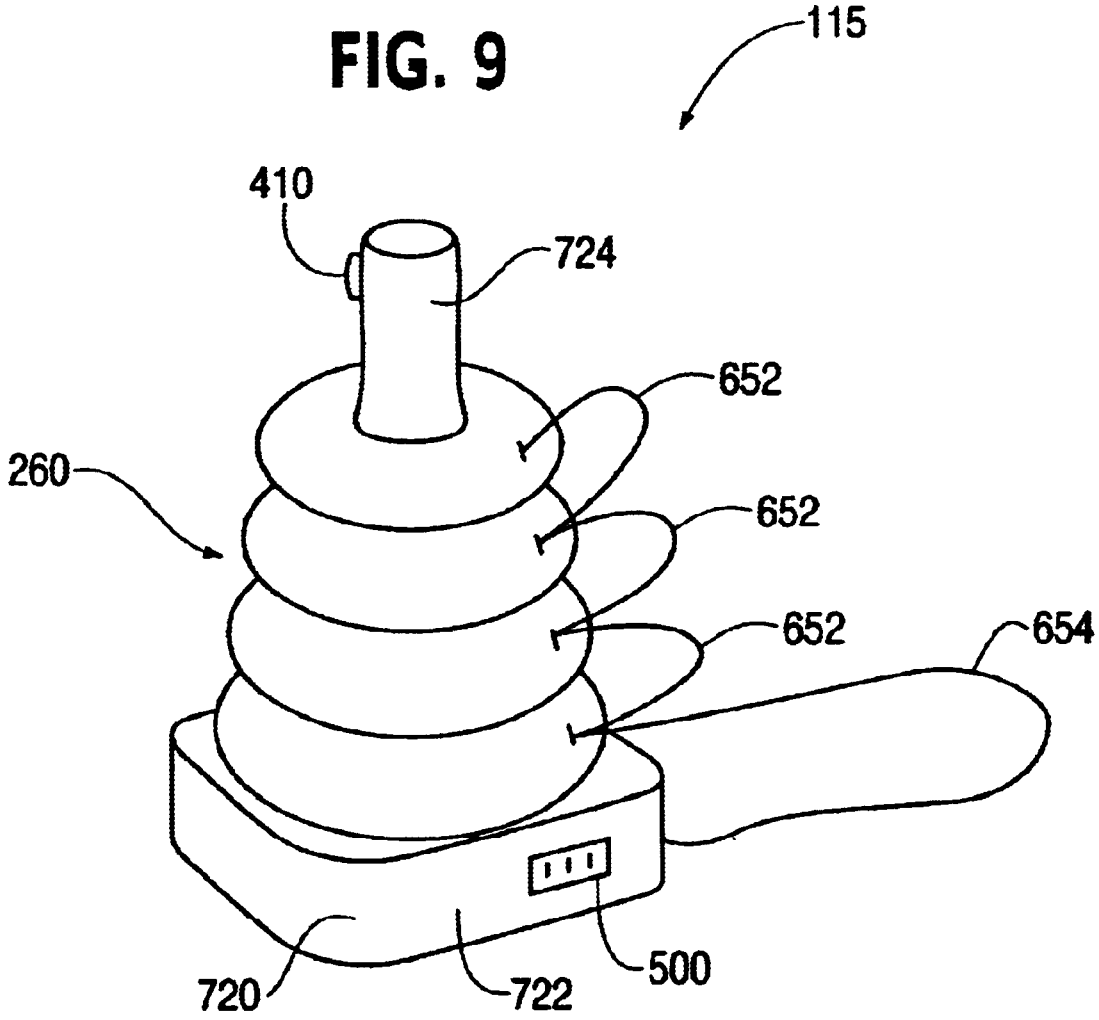
FIG. 9 is a perspective view of an alternative embodiment of the plurality of tethers of FIG. 7.
Figure 10:
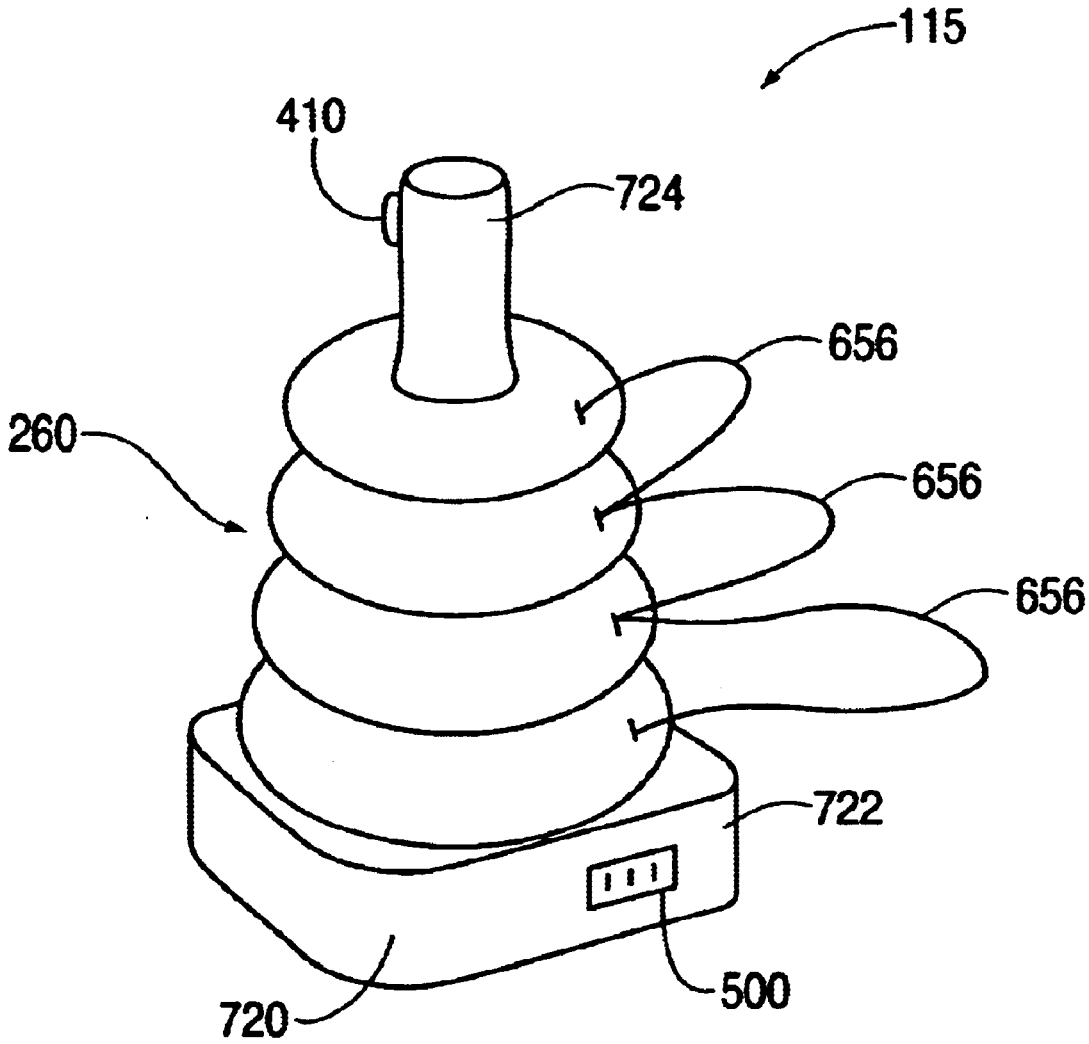
FIG. 10 is a perspective view of an alternative embodiment of the plurality of tethers of FIG. 7.
Figure 11:
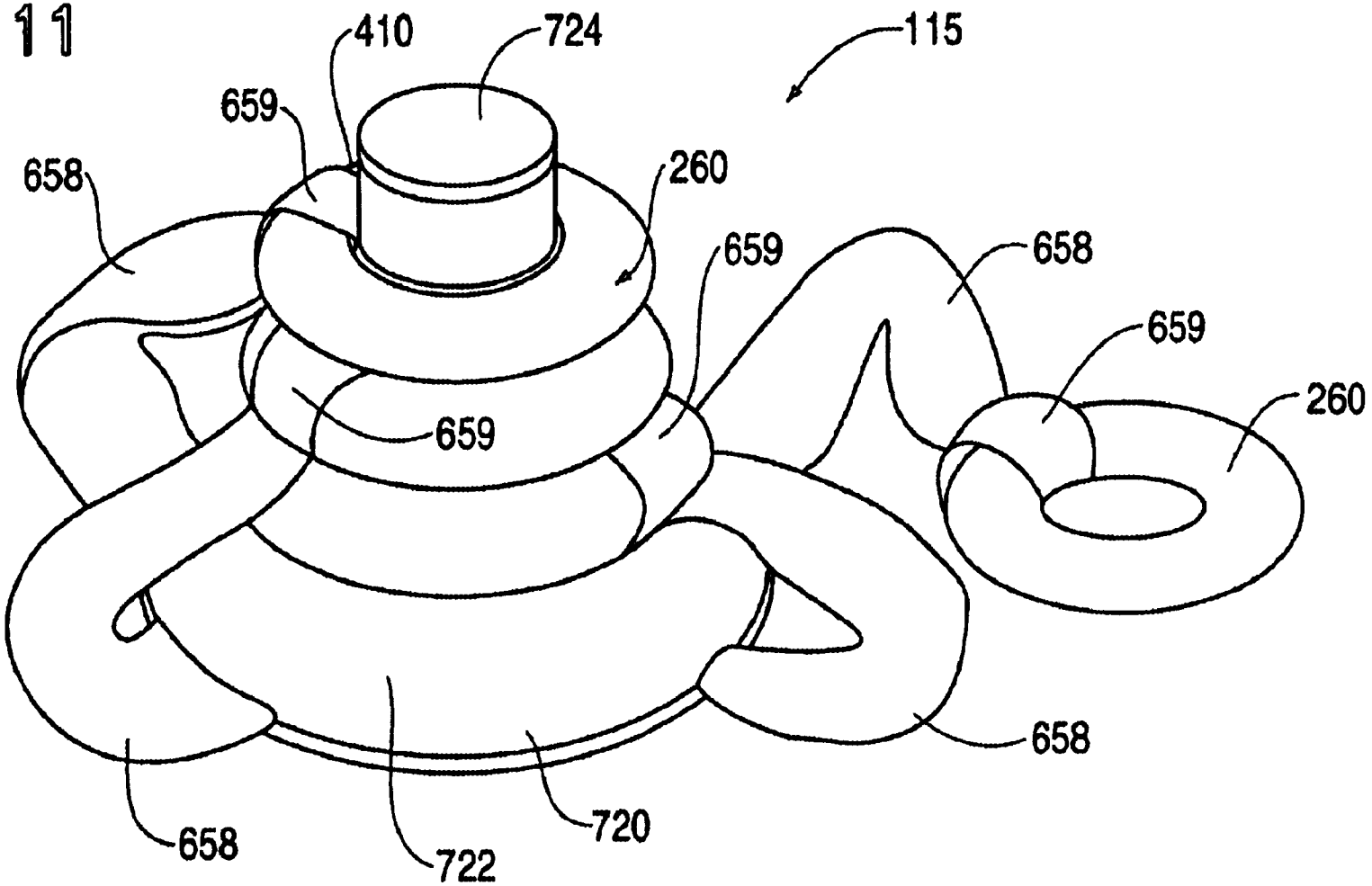
FIG. 11 is a perspective view of an alternative embodiment of the plurality of tethers of FIG. 7.

An alternative arrangement for coupling the plurality of articles using tethers 650 is shown in FIGS. 9–11. In the illustrated embodiment shown in FIG. 9, the plurality of articles 260 are tethered to each other by a plurality of tethers 652. An additional coupler or tether 654 is coupled between one of the plurality of articles 260 and the support 720 and more particularly the base 722. In this fashion, the plurality of articles 260 are retentively coupled together and retentively coupled to the support 720.

As illustrated in FIG. 10, a plurality of tethers 656 are coupled to and between each of the plurality of articles 260 thereby forming a set of articles 260 which can be removed as a unit from the support 720. Such an embodiment allows the support 720 to be used with additional sets of articles 260 thereby increasing the entertainment value for the infant and prolonging the useful life of the toy.

Referring to FIG. 11, a plurality of tethers 658 are coupled to each of the plurality of articles 260 and to the support 720. In one embodiment, the tethers 658 are made from a flexible fabric material. In alternative embodiments, the tethers 658 may be made from any suitable material, such as plastic and the like. As illustrated in FIG. 11, tethers 658 include a loop 659 at one end that is coupled around the body portion 262 of articles 260, while the other end is coupled to the support 720. In alternative embodiments, tethers 658 may be coupled to articles 260 in any suitable arrangement so long as articles 260 may be retentively coupled together or to the support 720. For example, tethers 658 could be integrally molded with the plurality of articles 260 or could be attached using glue, rivets, or other suitable fastening techniques or mechanisms.

Unless otherwise indicated herein, it is to be understood that the component parts of the invention are preferably made from a plastic material which can be molded and which is sufficiently durable and safe for use with infants and children of toddler age. Other materials, however, such as rubber, fabrics, foam rubber, and the like, could also be employed in the present invention.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A toy comprising:

a first article having a body portion and an engagement portion;

a second article having a body portion and an engagement portion adapted to engage said first article engagement portion such that said first article and said second article can be releasably coupled together;

a tether having a first end fixedly coupled to said first article body portion and a second end fixedly coupled to said second article body portion, said tether including a plurality of jointed rigid members;

a sensory output generator disposed on said first article; and an actuator disposed on said first article engagement portion and operatively coupled to said sensory output generator and operable to initiate operation of said sensory output generator in response to said first article engagement portion engaging said second article engagement portion.

2. The toy of claim 1, wherein said first article engagement portion includes a protrusion and said second article engagement portion defines a recess.

3. A toy comprising:

a support including a base and a support member extending from said base; and an article releasably engageable with said support, said article including:

a body portion including an engagement portion disposed on said body portion, said engagement portion including an opening formed through said body portion, said opening adapted to allow passage of said support member through said body portion to releasably engage said body portion to said support;

a tether coupled to said body portion and said support;

a speaker disposed on said support; and an actuator disposed on said support member and operatively coupled to said speaker to initiate an audible output through said speaker when said body portion engages said actuator.

4. The article of claim 3, further comprising:

a protrusion on one of said article and said support, and a recess on the other of said article and said support, said protrusion adapted to releasably mate with said recess.

5. The article of claim 4, wherein the recess extends along a length of the other of said article and said support.

6. The article of claim 4, wherein said protrusion and said recess have a dovetail configuration.

7. The article of claim 3, wherein said tether is coupled to said base.

8. An infant toy comprising:

a support having an upper surface, a base, and a post extending upwardly from said base;

a plurality of articles, each of said plurality of articles including a body portion and a coupler coupled to said body portion and to another one of said plurality of articles, each of said plurality of articles including an engagement portion adapted to releasably couple said plurality of articles to said support, said engagement portion including an opening formed through said body portion, said opening adapted to allow placement of said plurality of articles onto said post, said plurality of articles configured to be stackable on said upper surface of said support;

a sensory output generator disposed on said support; and an actuator disposed on said support, said actuator operatively coupled to said sensory output generator and operable to initiate operation of said sensory output generator in response to placement of one of said plurality of articles on said support.

9. An infant toy comprising:

a support having an upper surface;

a plurality of articles, each of said plurality of articles including a body portion and a coupler coupled to said body portion and to another one of said plurality of articles, each of said plurality of articles including an engagement portion adapted to releasably couple said plurality of articles to said support, said engagement portion includes a tab disposed on the body portion, said tab configured to engage a recess formed in said upper surface of said support to releasably couple said plurality of articles to said support, said engagement portion further includes a recess formed on said body portion, said recess adapted to engage said tab to releasably couple said plurality of articles together, said plurality of articles configured to be stackable on said upper surface of said support;

a sensory output generator disposed on said support; and an actuator disposed on said support, said actuator operatively coupled to said sensory output generator and operable to initiate operation of said sensory output generator in response to placement of one of said plurality of articles on said support.

10. The infant toy of claim 8, wherein:

said sensory output generator is disposed on said base; and said actuator is disposed on said post, said actuator being operable to initiate operation of said sensory output generator when one of said plurality of articles is disposed onto said post.

11. A stacking articles toy comprising:

a support including a base and a post extending outwardly from said base;

a plurality of articles, said plurality of articles including a body portion having an engagement portion adapted to releasably engage said support, said plurality of articles including a coupler coupled to said body portion and to said support to couple said plurality of articles and said support together, said plurality of articles adapted to be stackable on said support;

a sensory output generator disposed on said base; and an actuator disposed on said post, said actuator operatively coupled to said sensory output generator and operable to initiate operation of said sensory output generator in response to placement of one of said plurality of articles on said post.

12. The stacking articles toy of claim 11, wherein said engagement portion includes an opening formed through said body portion, said opening adapted to allow placement of said plurality of articles onto said post.

13. The stacking articles toy of claim 11, wherein said engagement portion includes a coupling member, and wherein said post includes a longitudinal groove formed therein, said coupling member adapted to releasably engage said groove.

14. The stacking articles toy of claim 13, wherein said coupling member and said groove have a dovetail configuration.

15. An infant toy comprising:

a support including a base and a post extending upwardly from said base;

a first annular article having a body portion, said first annular article adapted to be removably coupleable to said post;

a first coupler fixedly coupled to said first article body portion and to said support;

a second annular article having a body portion; and a second coupler coupled to said second article body portion and to said support, said second article adapted to be removably coupleable to said post and stackable on said first annular article.

16. An infant toy comprising:

a support including a base and a post extending upwardly from said base;

a first annular article having a body portion, said first annular article adapted to be removably coupleable to said post; and a first coupler fixedly coupled to said first article body portion and to said support;

a sensory output generator disposed on said support; and an actuator disposed on said post, said actuator operatively coupled to said sensory output generator and operable to initiate operation of said sensory output generator when said first annular article is placed onto said post.

17. A stackable ring toy comprising:

a support including a base having an upper surface and a member extending upwardly from said upper surface of said base; and a plurality of rings, each of said plurality of rings including a coupler fixedly coupled to and disposed between said ring and said support to couple said ring and said support together, each of said plurality of rings adapted to be disposed on said member and stackable on said upper surface of said base.

18. The stackable ring toy of claim 17, further including:

a speaker disposed on said support;

an actuator disposed on said member, said actuator operatively coupled to said speaker and operable to initiate audible output through said speaker when each of said plurality of rings is disposed on said member.

19. The stackable ring toy of claim 17, wherein each of said plurality of rings is a toroid.

20. The stackable ring toy of claim 17, wherein said coupler includes a flexible fabric tether.

21. The stackable ring toy of claim 17, wherein said coupler includes a plurality of jointed rigid members.

22. The stackable ring toy of claim 17, wherein each of said couplers is coupled to said base of said support.

23. The stackable ring toy of claim 22, wherein each of said couplers is coupled at different points on said base.

24. A plurality of articles releasably engageable to a support, the support having a base and a member extending from said base, the plurality of articles comprising:

a body portion including an engagement portion disposed on said body portion, said engagement portion includes an opening formed through said body portion, said opening adapted to allow passage of the support member through said body portion to releasably engage said body portion to the support member; and a tether coupled to each of said plurality of articles.

25. The plurality of articles of claim 24, further comprising:

a protrusion disposed on said plurality of articles or the support member, said protrusion adapted to releasably mate with a recess defined by the other one of said plurality of articles and the support member.

* * * * *